United States Patent [19]

Ferris et al.

[11] 4,274,629

[45] Jun. 23, 1981

[54] COMBATIVE GAME APPARATUS

[75] Inventors: Michael J. Ferris; Henry Arias, both of Chicago, Ill.

[73] Assignee: Marvin Glass & Associates, Chicago, Ill.

[21] Appl. No.: 82,541

[22] Filed: Oct. 9, 1979

[51] Int. Cl.[3] ..... A63F 9/00

[52] U.S. Cl. ..... 273/1 R; 46/142

[58] Field of Search ..... 273/1 R, 1 E, 1 M; 46/142, 143, 148

[56] References Cited

U.S. PATENT DOCUMENTS

| | | | |
|---|---|---|---|
| 2,269,095 | 1/1942 | Davis | 46/142 |
| 3,456,944 | 7/1969 | Ryan et al. | 273/1 R |
| 3,540,725 | 11/1970 | Hill | 273/1 R |
| 3,792,858 | 2/1974 | Cross, Jr. et al. | 273/1 R |

*Primary Examiner*—Paul E. Shapiro

*Attorney, Agent, or Firm*—Mason, Kolehmainen, Rathburn & Wyss

[57] ABSTRACT

A competitive action game apparatus includes a playing surface defined on a base movably mounting at least two figures for relative movement. The figures each include a manual actuator and at least one pivotal, removably attached, outwardly extending arm which includes, on the outer end thereof, a hook or similar grabbing device for hooking onto an object. The actuator comprises a depending handle or similar member which is attached to the body for rotating the body relative to the playing surface. In the preferred embodiment, the two figures each include a plurality of arms and are rotatably mounted on the surface at locations such that the hook ends of the arms can engage one another, detaching one of the arms from the corresponding figure thereby providing a fighting action.

12 Claims, 4 Drawing Figures

COMBATIVE GAME APPARATUS

BACKGROUND OF THE INVENTION

1. Field of the Invention

The present invention relates to competitive or fighting toys and in particular to a new and improved action game.

2. Brief Description of the Prior Art

Competitive games that employ action pitting two or more players against each other are highly popular among children. The prior art includes a large number of competitive games such that each new competitive game must require a new and different action or scoring procedure that increases the competitive nature of the game while making it appealing to children.

Typical prior art competitive games require offensive and defensive action by the children playing the game and after a score is made the action is repeated. Typical prior art are U.S. Pat. No. 3,235,359 to Glass et al and U.S. Pat. No. 3,864,870 to Breslow et al as well as many others. This repetitiveness of play can result in a child rapidly losing interest in the game. Accordingly, it is desirable to provide a game in which the action is not stopped once a score is made.

It is also desirable that such a game include visual means of scoring that places the player losing the score at a competitive disadvantage as opposed to prior art games wherein the individual losing a particular score is at the same advantage when the game is repeated. Such a toy increases competitiveness and excitement since the loser of a score is continually put at a greater disadvantage thus decreasing the odds of the loser of each score winning the game, but also increasing the loser's desire and excitement if the game is won despite losing the score.

SUMMARY OF THE INVENTION

Another object of the present invention is to provide a new and improved action game wherein the action is continued as scores accumulate.

A further object of the present invention is to provide a new and improved action game for children that is entertaining and improves the child's manual dexterity.

The present invention is directed to a new and improved action game including a playing surface on a base on which, in the preferred embodiment, two figures are rotatably mounted. The bodies are adapted to be rotated by handles that can be twisted or twirled by the child playing the game. Each body has detachably and pivotally mounted thereto a plurality of arms at the free end of which are defined hooks or similar type grasping structures. Upon rotation of the body, the hooks engage each other detaching an arm from one of the two bodies thus defining a score for the child operating the body to which an arm remains attached.

BRIEF DESCRIPTION OF THE DRAWINGS

The above and other objects and advantages and novel features of the present invention will become apparent from the following detailed description of the preferred embodiment of the invention illustrated in the accompanying drawing wherein.

DESCRIPTION OF THE PREFERRED EMBODIMENT

Figure 1:
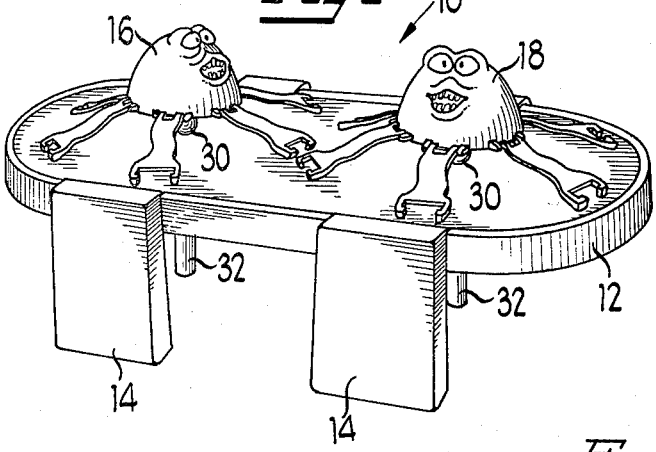
FIG. 1 is a perspective view of a game constructed in accordance with the principles of the present invention.

Referring now to the drawings and initially to FIG. 1, there is illustrated a game generally designated by the reference numeral 10. The game 10 is intended to be employed by persons of all ages, but particularly by children, and provides a combative action, while improving manual dexterity and providing competition through continuous scoring.

The game 10 includes a playing field or surface 12 that is mounted on a plurality of rigid legs 14, such that the surface 12 is supported above a table or similar supporting surface allowing the user's hands to be placed beneath the surface 12. The playing surface 12 can be of any particular design but preferably is in accordance with the theme of the game 10. As illustrated in FIG. 1, the theme of the game 10 of the embodiment shown is that of a pair of sea creatures such as octupuses or crabs 16 and 18 in combat. The playing field 12 may be of a configuration of a sandy bottom of an ocean, lake or similar body of water. The FIGS. 16 and 18 are rotatably mounted on the surface 12 and may be in any configuration having multiple appendages, but in the preferred embodiment illustrated, are in the fanciful configuration of crabs.

Figure 3:
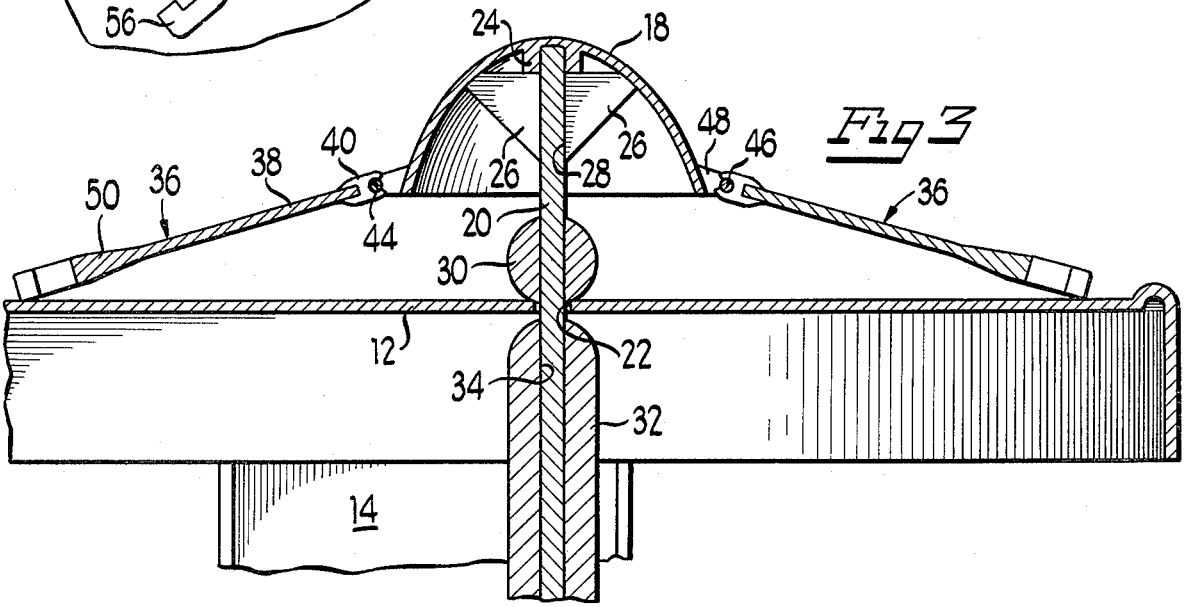
FIG. 3 is a fragmented vertical cross-section view of one of the rotatable figures included in the game.

As best illustrated in FIG. 3, the body portion 18 is dome-shaped and is mounted on a rod 20 extending through an aperture 22 defined in the playing field 12. The body 18 is semi-circular and includes an integral receptacle 24 defined at the top inner peripheral surface of the body 18 into which the upper end of the rod 20 is inserted and held by a press fit or similar procedure so as to secure the body 18 to the rod 20. The body 18 also includes a plurality of ribs 26 defining a central aperture 28 through which the rod 20 extends. The ribs 26 engage the rod 20 to allow the body 18 to be rigidly secured to the rod 20 and prevent angular displacement of the body 18 relative to the rod 20.

To elevate the rod 18 above the playing surface 12 by a predetermined amount, a stop 30 is pressed onto the rod 20 above the playing surface 12, thus preventing the rod 20 from sliding through the aperture 22 allowing the body 18 to engage the playing surface 12. If this were to occur, the increased friction would make rotation of the body 18 more difficult. The stop 30 is of a circular configuration thus, reducing the surface of the stop 30 contacting the playing surface 12 and reducing the friction created.

The rod 20 extends below the playing surface 12 a sufficient amount to allow a child operating the game 10 to grasp the rod 20 and rotate it thus spinning or rotating the body 18 relative to the playing surface 12. To allow the child to grasp the rod 20 easily, handle 32 of any configuration, but in the preferred embodiment, is cylindrical and fits on the rod 20 by insertion of the rod 20 into an elongated aperture 34 defined in the handle 32. As can be understood by one skilled in the art, the elevation of the playing surface 12 above the table by the legs 14 allows easy grasping of the handle 32 by the child operating the toy 10.

As shown, the stop 30 and the handle 32 substantially prevent any vertical movement of the rod 20, however, if desired, the handle could be positioned lower to permit raising or lowering of the figure to alter the play of the game as described hereinafter. The combative nature and scoring of the game 10 is provided by a plurality of arms 36 detachably and pivotally secured to the FIGS. 16 and 18 at their inner ends 38 through the employment of a clamp or clip member 40. The clips 40 attach by means of a snap groove 44 that may be snapped onto a rod 46 mounted on a clevis 48 defined at angular positions around the outer periphery of the FIGS. 16 and 18. Through this connection, the arms 36 may be snapped away from the connection to the body 18. Also, upon high speed rotation of the FIGS. 16 and 18, this connection allows the arms 26 to pivot upwardly relative to the FIGS. 16 and 18 due to centrifugal force. At the free end 50 of each arm 36, there is included a hook-like mechanism generally designated by the reference numeral 52 that is U-shaped and includes two flanges 54 and 56 defined thereon which can hook the opposite flanges 54 and 56 in the manner illustrated in FIG. 4.

Figure 4:
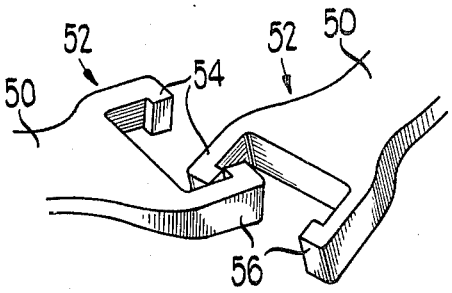
FIG. 4 is an enlarged detailed view of the ends of the arms of the figures employed in the game of the present invention.
Figure 2:
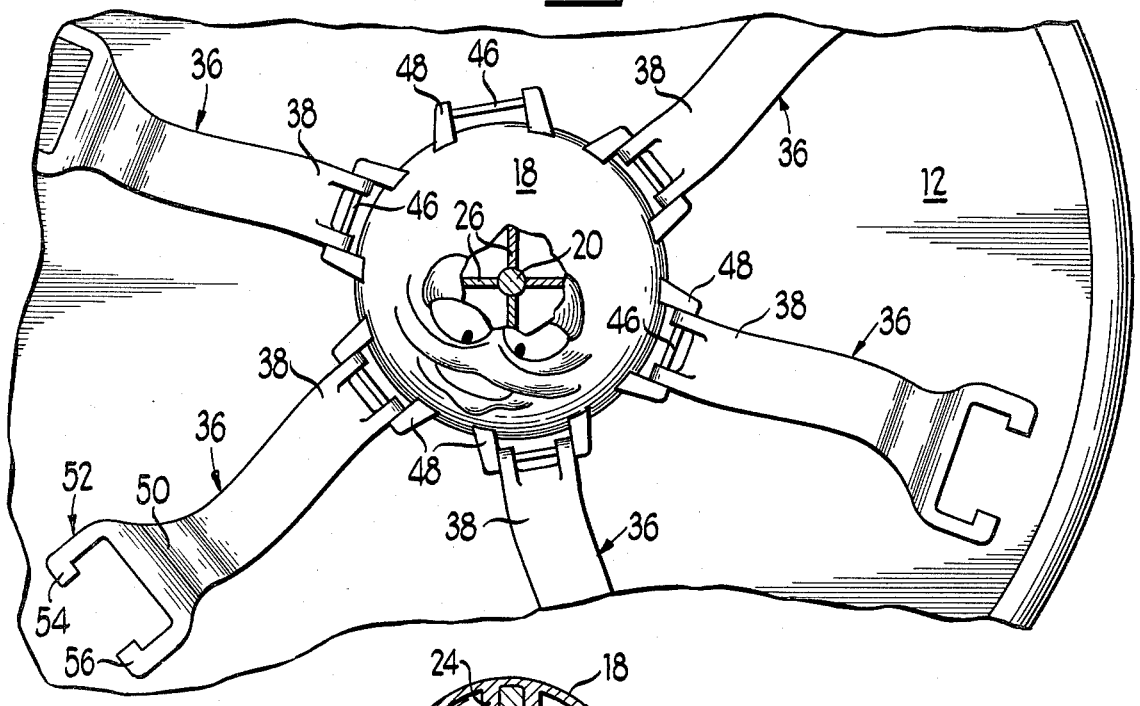
FIG. 2 is an enlarged partially fragmented plan view of one of the rotatable figures of the game.

The bodies 16 and 18 are mounted on the playing surface 12 with a predetermined space therebetween so that only the hook structures 52 on the individual arms 36 are able to engage each other in the manner illustrated in FIG. 4. Consequently, the players playing the game 10 rotate the FIGS. 16 and 18 in a manner so as to engage the hook structures 52 on the individual arms 36. A score is accomplished as one of the arms 36, as a result of this engagement, is removed from one of the FIG. 16 or 18. The FIG. 16 or 18 with the greatest number of arms is the leading score; however, after each score, the game is not stopped but continues until all of the arms have been detached from one of the FIG. 16 or 18. Although the player rotating one of the FIG. 16 or 18 may have fewer number of arms remaining on his or her body 16 or 18, there is still an opportunity to win the entire game since the fewer number of arms does not dictate losing the entire game. In addition, the faster the FIG. 16 or 18 are rotated, the arms 36 are pivoted relative to the playing surface 12 and lifting of the arms 36 off the playing surface 12 will occur. Consequently, the players playing the toy 10 must also employ manual skills as well as intelligence in manipulating the FIGS. 16 and 18 to their advantage to engage the hook structure 52 of the other player's FIG. 16 or 18 so as to insure detaching one of the arms 36 from the opponent while not detaching the arms from his or her own FIG. 16 or 18. If vertical movement of the bodies is permitted, as described above, the players can avoid capture by lifting their associated FIG. 16 or 18. As can be understood, as scores are accumulated by detachment of the arms 36, the competitiveness of the game 10 increases further increasing the excitement and the reliance of the player's own skills and intelligence to overcome any disadvantages through the detachment of arms 36 in order to win the game.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A combative toy, comprising:

a playing surface:

a movable member rotatably mounted on said playing surface;

means for rotating said movable member;

at least one appendage detachably secured to said movable member; and a second movable member rotatably mounted on said playing surface, means for rotating said second member, at least one appendage detachably secured to said second member, said appendage on each movable member including at an outer end thereof means for hooking the corresponding means for hooking defined on the appendage detachably secured to the other movable member;

said appendage including an inner end with means for connecting said appendage to said movable member, said connecting means allowing vertical movement of said appendage relative to said playing surface due to centrifugal force upon rotation of said movable member.

2. The toy of claim 1 wherein said second body member is mounted on said playing surface to allow the hooking means of the respective movable members to engage during rotation thereof.

3. The toy of claim 1 wherein said appendage is pivotally mounted on said movable member.

4. The toy of claim 1 wherein said rotating means comprises a post secured to said movable member and extending through said playing surface.

5. The toy of claim 1 wherein said movable members are mounted by means for permitting sliding movement toward and away from one another.

6. A combative action toy, comprising:

a playing field adapted to be elevated over a supporting surface;

at least two figures rotatably mounted on said playing field;

means secured to each of said figures to facilitate rotation of said figures;

a plurality of appendages detachably and pivotally secured to each of said figures by means for allowing vertical pivoting upon rotation of said figures; and means defined on each of said appendages for grasping said similar means on corresponding appendages on adjacent figures.

7. The toy of claim 6 wherein said figures are mounted on said playing field a predetermined distance apart to allow engagement of said grasping means.

8. The toy of claim 6 wherein said grasping means comprises a U-shaped end with inwardly extending projections on each of said arms.

9. The toy of claim 6 further comprising legs for supporting said playing field.

10. An action toy comprising:

a playing surface;

at least first and second figures rotatably mounted on said playing surface, said bodies mounted on said surface at predetermined distances from one another;

a handle secured to each of said figures extending through said playing surface allowing said handles to be grasped and rotated;

a plurality of arms removably and pivotally secured to said figures by means for allowing pivotal movement vertically relative to said playing surface upon rotation of said figures; and a hook defined on an end of each of said arms.

11. The toy of claim 10 wherein said hook is U-shaped with inwardly directed projections.

12. The toy of claim 10 further comprising a stop member secured to each of said handles to support said figures a predetermined distance above said surface.

* * * * *